US009415982B1

(12) United States Patent
Roovers et al.

(10) Patent No.: US 9,415,982 B1
(45) Date of Patent: Aug. 16, 2016

(54) TRIKE LIFT AND THE METHODS OF MAKING AND USING THE SAME

(71) Applicants: Tanner J. Roovers, Buchanan, WI (US); Stephen G. Roovers, Buchanan, WI (US)

(72) Inventors: Tanner J. Roovers, Buchanan, WI (US); Stephen G. Roovers, Buchanan, WI (US)

(73) Assignee: J & S JACKS, LLC, Little Chute, WI (US)

( * ) Notice: Subject to any disclaimer, the term of this patent is extended or adjusted under 35 U.S.C. 154(b) by 358 days.

(21) Appl. No.: 13/967,316

(22) Filed: Aug. 14, 2013

Related U.S. Application Data

(60) Provisional application No. 61/684,060, filed on Aug. 16, 2012.

(51) Int. Cl.
*B66F 7/28* (2006.01)

(52) U.S. Cl.
CPC ..... *B66F 7/28* (2013.01)

(58) Field of Classification Search
None
See application file for complete search history.

(56) References Cited

U.S. PATENT DOCUMENTS 2,124,754 A * 7/1938 Simpson ..... B60N 2/1615 108/145
4,305,439 A * 12/1981 Skinner ..... B23Q 1/48 144/135.2
4,457,492 A * 7/1984 Lahti ..... B66F 15/00 254/114
5,372,353 A * 12/1994 West ..... B25H 1/0007 254/10 B
5,377,782 A * 1/1995 Francis ..... B66F 7/0641 187/217
5,769,396 A * 6/1998 Tischendorf ..... B62M 3/00 254/10 C
6,769,668 B2 * 8/2004 Siglock ..... B66F 5/04 254/124
2005/0189526 A1 * 9/2005 Bettencourt ..... B66F 5/04 254/10 B

OTHER PUBLICATIONS

K&L Supply Co., K&L MC650R Hydraulic Lift, as viewed at website http://klsupply.com/lift/mc650/ on Dec. 23, 2013. 2 pages.
Watson's MFG., LLC, Pitbull Motorcycle Lifts, Trike on a Pitbull Motorcycle Lift, as viewed at website http://www.pitbullmotorcyclelifts.com/gallery/main.php?g2_itemId=29 on Dec. 28, 2013. 2 pages.
Pace Tools, Inc., VTL-1300, as viewed at http://www.pacetools.com/Products/VTL-1300 on Jun. 27, 2012. 1 page.

* cited by examiner

*Primary Examiner* — Joseph J Hail
*Assistant Examiner* — Brian Keller
(74) *Attorney, Agent, or Firm* — Brannen Law Office, LLC

(57) ABSTRACT

The present invention relates to an improved trike lift having a vertical extension for engaging a high point of the trike body bottom, and to the methods of making and using the same. The lift has a frame with base arms, lift arms and upper arms that act generally as a parallelogram. One of the upper arms has a pad to engage the body bottom of the trike. The other upper arm has an extension block that can be selectably raised and lowered. In one embodiment, the extension block can be manually raised. In another embodiment, the extension block can be mechanically raised. The lift also has an elevation assembly with a handle having a stepped top arm.

12 Claims, 15 Drawing Sheets

TRIKE LIFT AND THE METHODS OF MAKING AND USING THE SAME

This United States utility patent application claims priority on and the benefit of provisional application 61/684,060 filed Aug. 16, 2012, the entire contents of which are hereby incorporated herein by reference.

BACKGROUND OF THE INVENTION

1. Field of the Invention

The present invention relates to an improved trike lift having a vertical extension for engaging a high point of the trike body bottom, and to the methods of making and using the same.

2. Description of the Related Art

The present invention is designed for use with a trike 5. Trikes are a type of three wheeled motorized vehicle, and generally have a front 10, a rear 11 and sides 12. Trikes are becoming more popular today and the number of trikes in operation continues to rise. Of course, tikes need service and repair, just as motorcycles need service and repair. Yet, while there are many motorcycle lifts and jacks available, there are very few trike lifts.

One reason for this is that trikes 5 have a body bottom 15 that is not conducive to being lifted. This is because the overall weight of the trike 5 is not centered on the center of the body bottom 15. Trikes do have other components, such as a swing arm, in a bottom high section 16. Yet, until the present invention, there have not been any attempts to utilize these other portions to gain leverage to lift the trike 5 in a stable manner.

None of the known lifts have an extension that is selectably raised and lowered. Specifically, none show a lift that can be positioned under a trike with an extension in a low position, wherein the extension can then be raised to engage a swing arm or other portion of a trike.

None show the use of two engagers that provide two lift points that allow the trike to be balanced and stable during the lift.

None show a lift with a top arm step that allows the lift to perform its function without interruption from the trike fender.

Thus there exists a need for a trike lift and the methods of making and using the same that solves these and other problems.

SUMMARY OF THE INVENTION

The present invention relates to an improved trike lift having a vertical extension for engaging a high point of the trike body bottom, and to the methods of making and using the same. The lift has a frame with base arms, lift arms and upper arms that act generally as a parallelogram. One of the upper arms has a pad to engage the body bottom of the trike. The other upper arm has an extension block that can be selectably raised and lowered. In one embodiment, the extension block can be manually raised. In another embodiment, the extension block can be mechanically raised. The lift also has an elevation assembly with a handle having a stepped top arm.

According to one advantage of the present invention, the lift has an extension block (or extension) that is selectably raised and lowered. Specifically, the trike lift can be moved into position from the side of a trike with the extension block in a low position. Then, the extension block can be raised to engage a swing arm or other portion of a trike. In one preferred embodiment, the extension block is manually raised from the low position to the high position. This is advantageously accomplished with the use of a J channel, wherein the user manually operates the extension block within the J channel.

In another preferred embodiment, the extension block is mechanically moved between high and low positions. This can be advantageously accomplished via a lever that toggles cams between an inactive or down position and an upright or active position.

Related, the mechanically moved extension block has redundant safety features. In this regard, the cams have flat tops so that when a vertical load is applied to the lift, the cams are unable to move without first overcoming the vertical load. Second, a pin or other locking device can be used to secure the lever in its position so that the lever cannot be unintentionally used to lower the extension block.

According to another advantage of the present invention, the lift uses two engagers that provide two lift points that allow the trike to be balanced and stable during the lift.

According to a still further advantage of the present invention, the lift is provided with a top arm step that allows the lift to perform its function without interruption from the trike fender and without the need to first remove the fender before using the lift.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
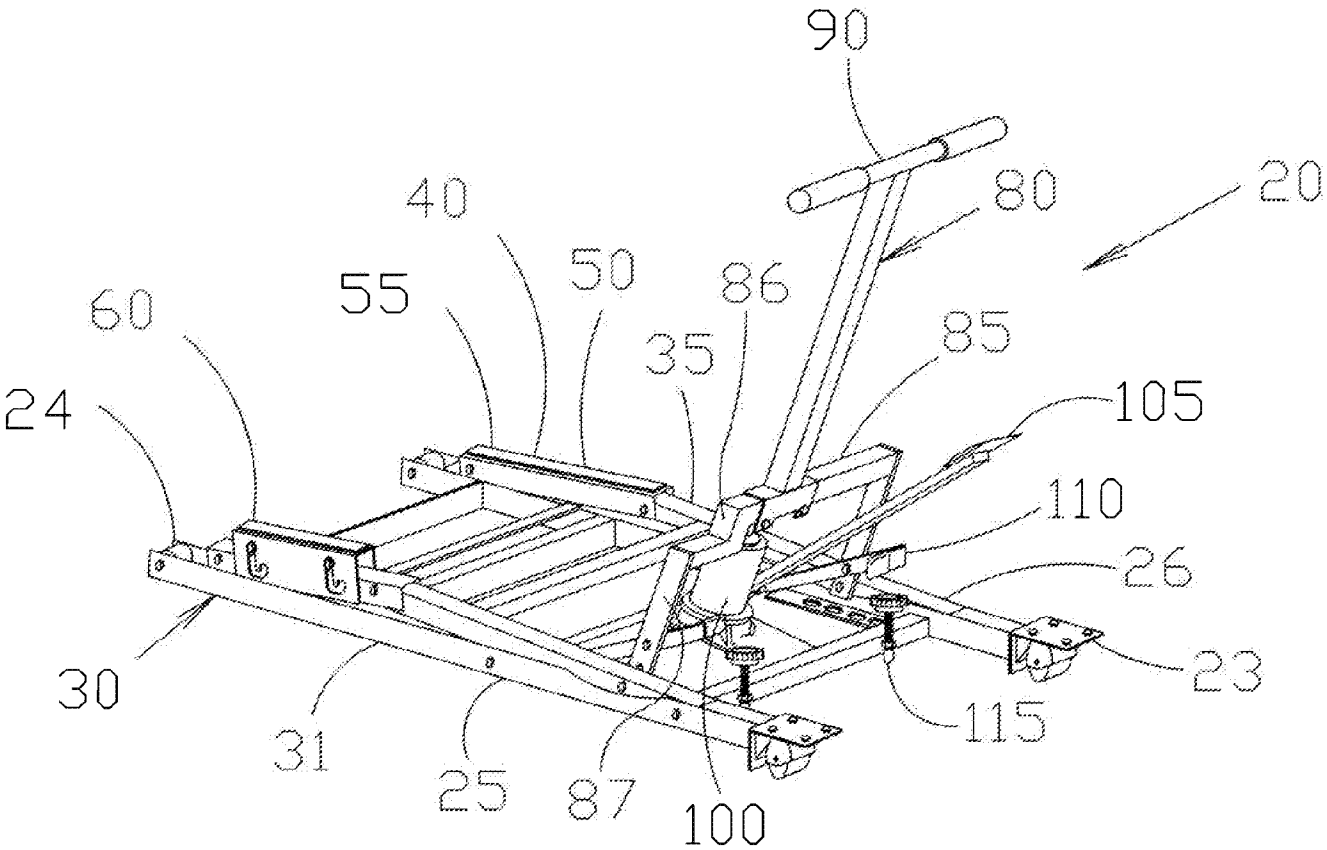
FIG. 1 is a perspective view of a preferred embodiment of the present invention shown in the low position.
Figure 2:
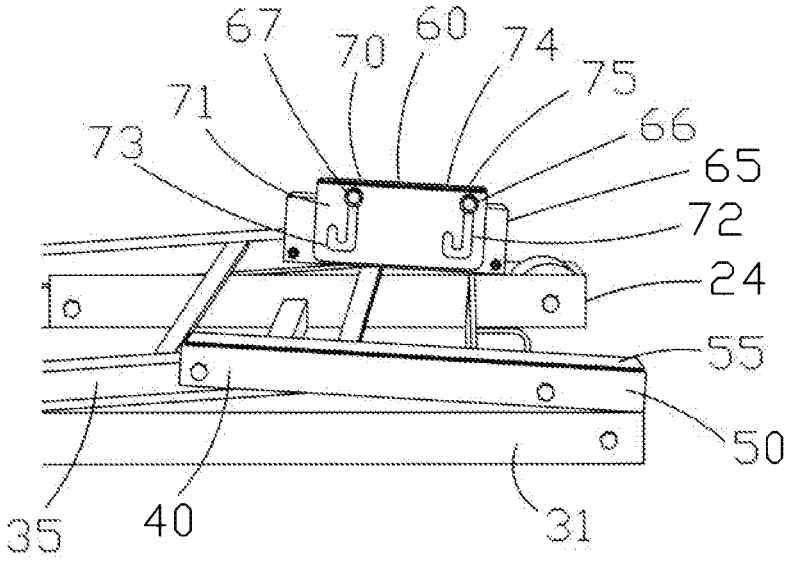
FIG. 2 is a side view of an extension block shown in the low position.
Figure 3:
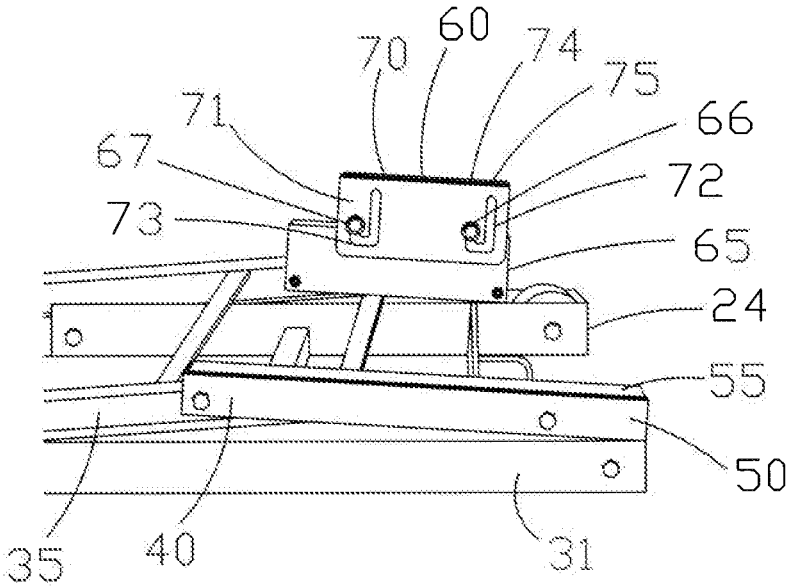
FIG. 3 is a side view similar to FIG. 2, but shows the extension block in a high position.
Figure 4:
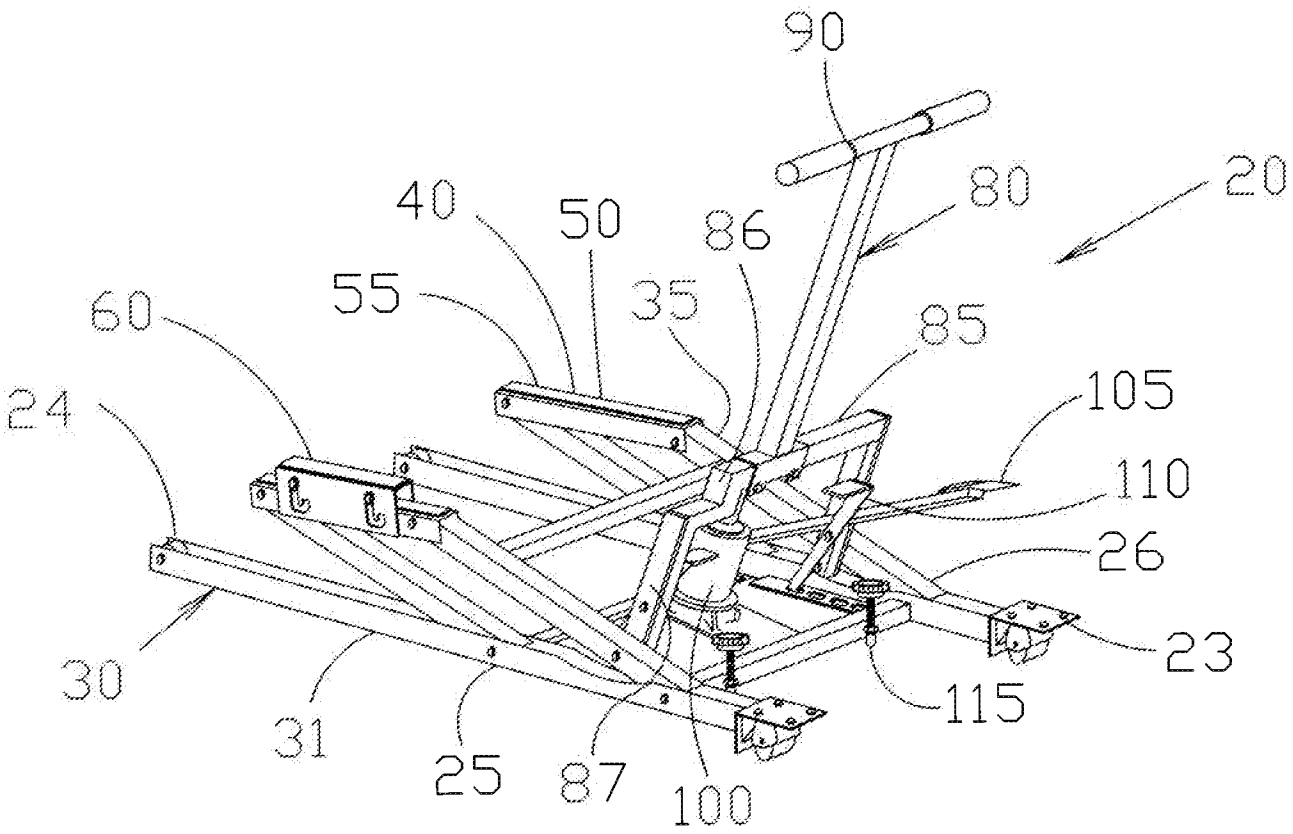
FIG. 4 is similar to FIG. 1, but shows the embodiment in an intermediate position.
Figure 5:
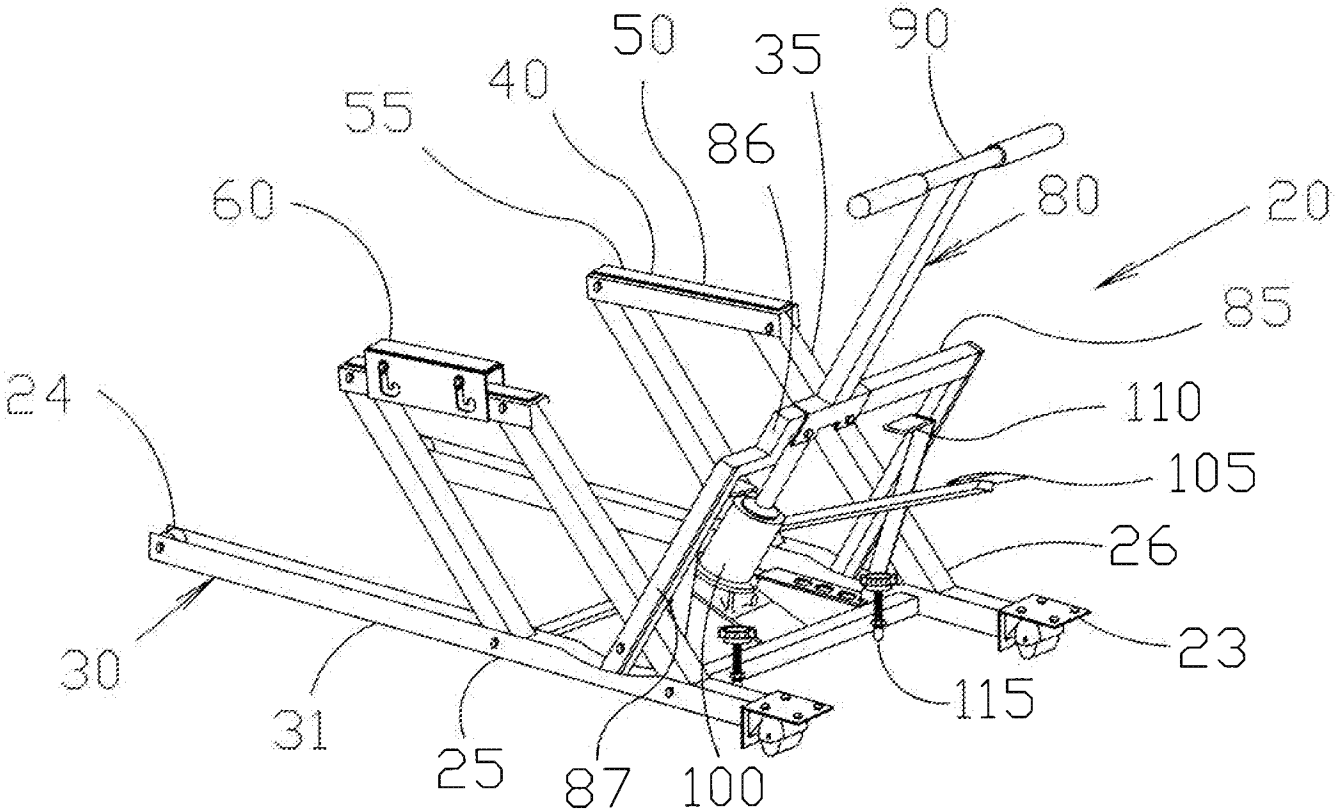
FIG. 5 is similar to FIG. 1, but shows the embodiment in a high position.
Figure 6:
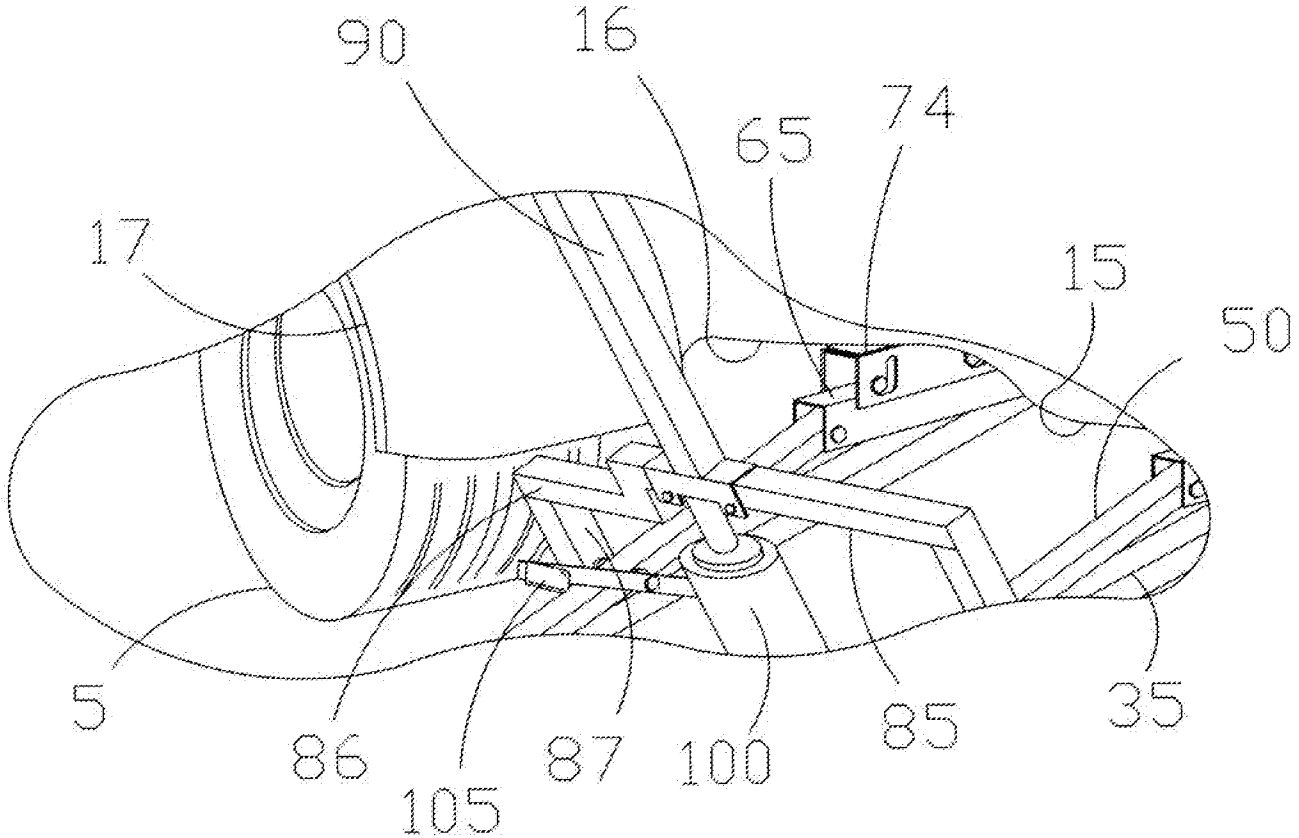
FIG. 6 is a close up view showing the step in the lift top arm clearing the fender of a trike and the engagers engaging the bottom of the trike.
Figure 7:
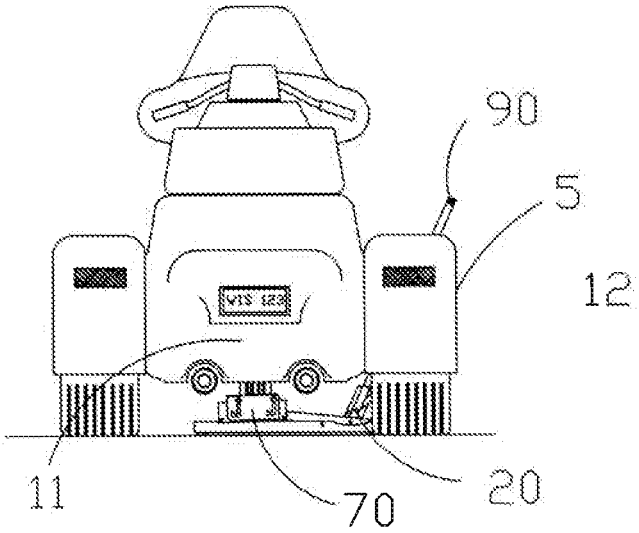
FIG. 7 is a rear view showing the lift in position under a trike with the extension block in a low position.
Figure 8:
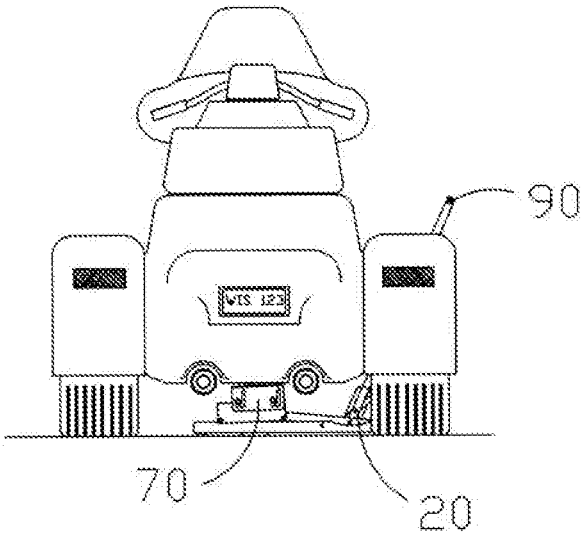
FIG. 8 is similar to FIG. 7, but shows the extension block in a high position.
Figure 9:
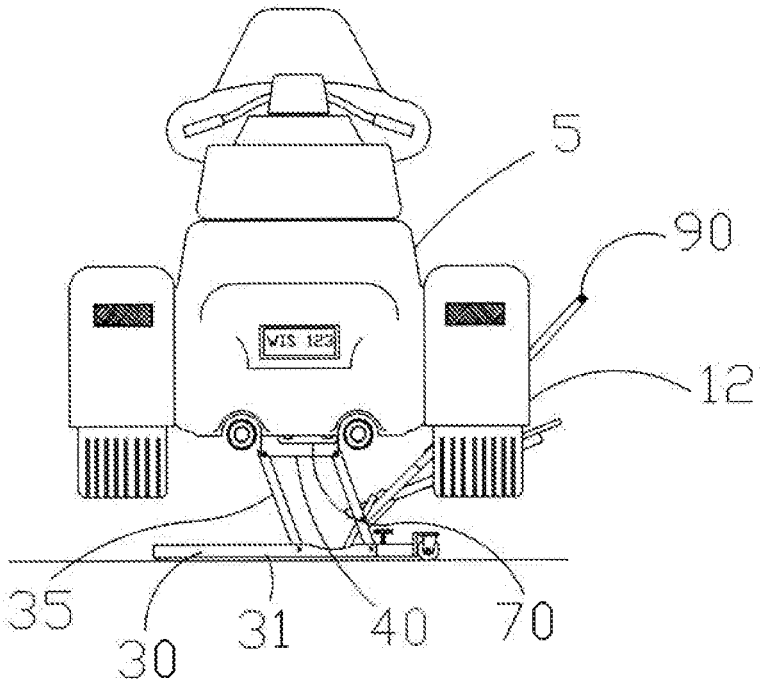
FIG. 9 is a rear view showing a trike being supported off of the ground by the lift of the present invention.

Turning now to FIGS. 1-9 generally, it is seen that a first preferred embodiment is illustrated. In this regard, it is seen that a lift 20 is provided having ends 23 and 24, and sides 25 and 26. The lift 20 has a frame 30 and an elevation assembly 80. The lift 20 is preferably made of strong materials such as steel. However, it is appreciated that other materials may be used without departing from the broad aspects of the present invention.

Frame 30 has base arms 31, lift arms 35 and upper arms 40. These three sets of arms preferably act generally as a parallelogram in raising and lowering the upper arms 40 relative the base arms 31. The lift arms 35 are pivotally connected to the base arms 31 at one end and to the upper arms 40 at the opposite ends, respectively.

There are preferably two upper arms. The first upper arm preferably has a body bottom lower section engager 50. The engager 50 can have a pad 55 comprising a compressible or high friction material so that the trike is stably engaged by the engager.

The second upper arm preferably has a body bottom higher section engager 60. Engager 60 has a base 65 and an extension block 70. The base 65 has two pins 166 and 167 fixed to the top of the base. The extension block 70 has sides 71 and a top 74. The top 74 has a pad 75 preferably of the same material as the material of pad 55. Each side 71 has two J channels 72 and 73, respectively.

The pins 66 and 67 of the first piece extend within the two J channels 72 and 73, respectively. In this regard, the extension block is raisable and lowerable to the two positions defined by the J channels. In this embodiment, it is preferred that the extension block 70 is extended and compacted manually by the user. In the low position, pad 75 is preferably about two inches higher than pad 55. However, in the high position, pad 75 is preferably about five inches higher than pad 55.

An elevation assembly 80 is provided. The assembly 80 has a top arm 85 and side arms 87. The top arm 85 is stepped. In this regard, a section of the top arm is removed in order for the elevation assembly 80 to clear the fender 17 of a trike. Step 86 has a first portion and a second portion. The first portion is generally parallel to the side arms, and the second portion is generally perpendicular to the first portion. It is appreciated that the step 86 could have different shapes without departing from the broad aspects of the present invention.

A handle 90 is further provided, as is a hydraulic lift 100 for providing hydraulic force to raise the lift, a release 105 for releasing the hydraulic force to lower the lift, locks 110 to secure the lift in a high position and floor engagers 115 to prevent movement of the lift.

In use, it is appreciated that the lift is inserted under the trike from the side 12 of the trike. The extension block 70 is preferably in the low position whereby it can clear the fender 17 and body bottom sections. Once in position, the extension block is preferably raises so that pad 75 is about five inches higher than pad 55. Elevation assembly is then used to cause the lift frame 30 to rise. Pad 55 engages the body bottom and pad 75 engages the body bottom high section (preferably the swing arm). In this regard, the weight of the trike is centered on the lift and the lift can lift the trike in a stable manner.

Figure 10:
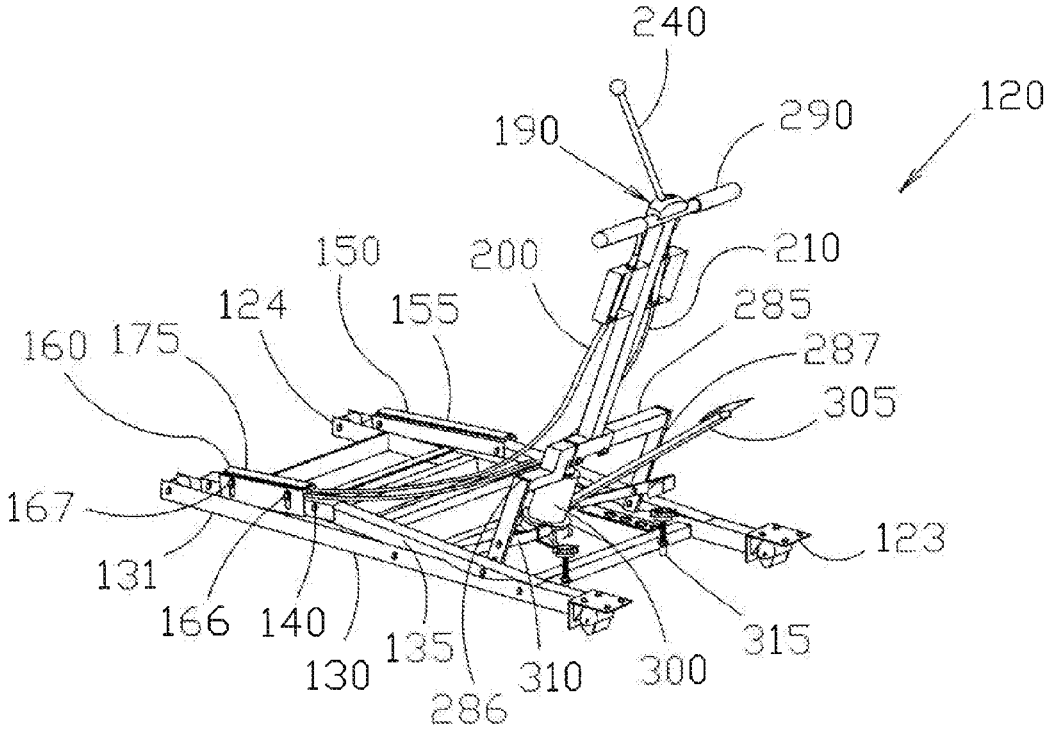
FIG. 10 is a perspective view of an alternative embodiment of the present invention in a low position and showing an alternative extension block in the low position.
Figure 11:
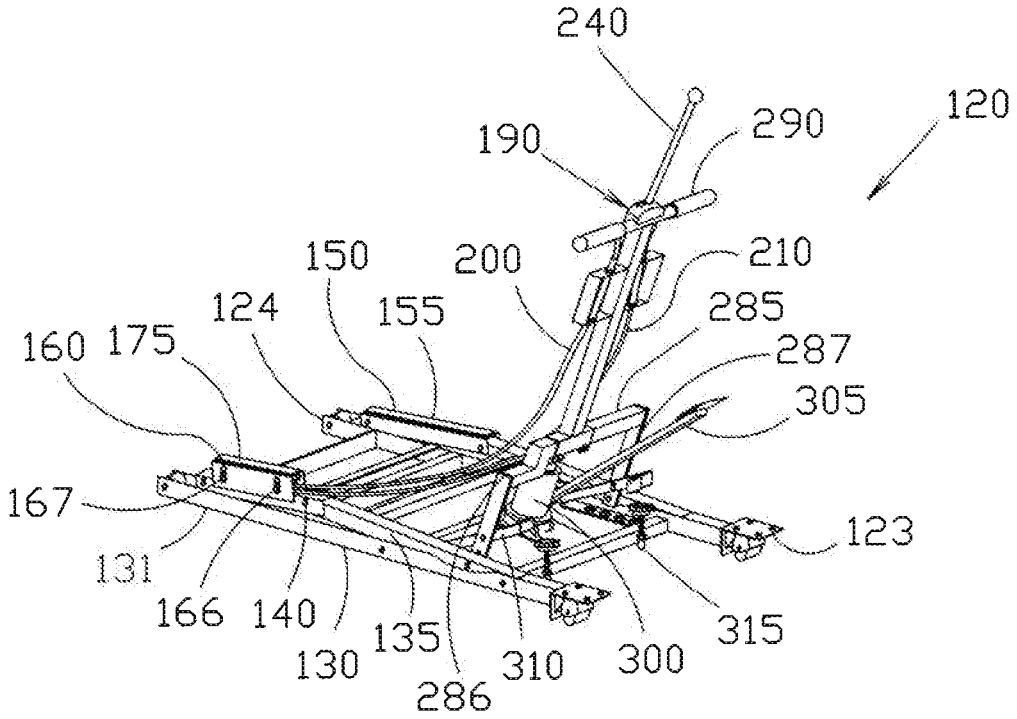
FIG. 11 is similar to FIG. 10, but shows the extension block in a high position.
Figure 12:
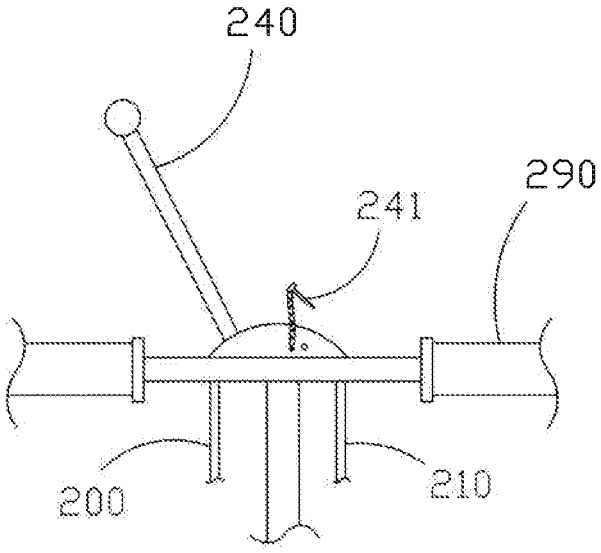
FIG. 12 is a rear view showing the mechanical lever in a first position.
Figure 12A:
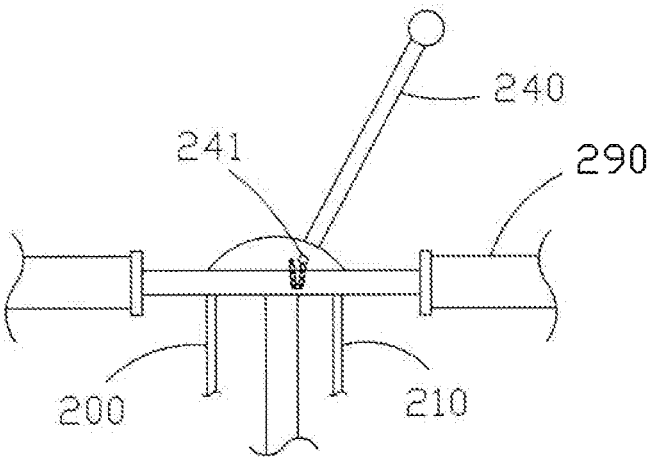
FIG. 12A is similar to FIG. 12, but shows the lever in the second position with a safety pin in place.
Figure 13:
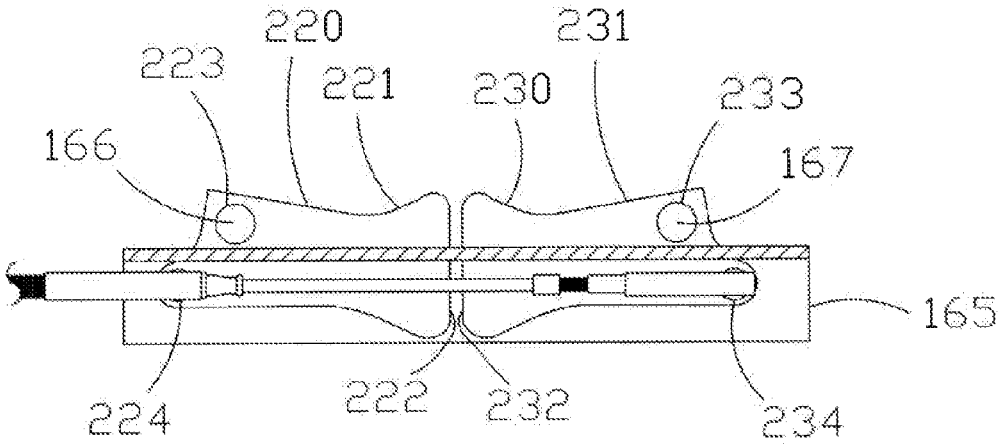
FIG. 13 is a side isolation view showing the cams of the drive system in an inactive or down position.
Figure 13A:
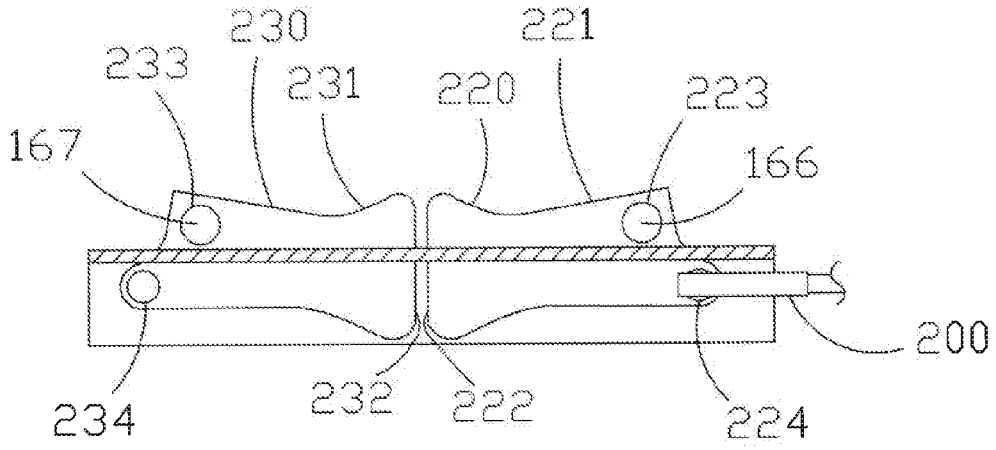
FIG. 13A is a reverse angle of FIG. 13.
Figure 14:
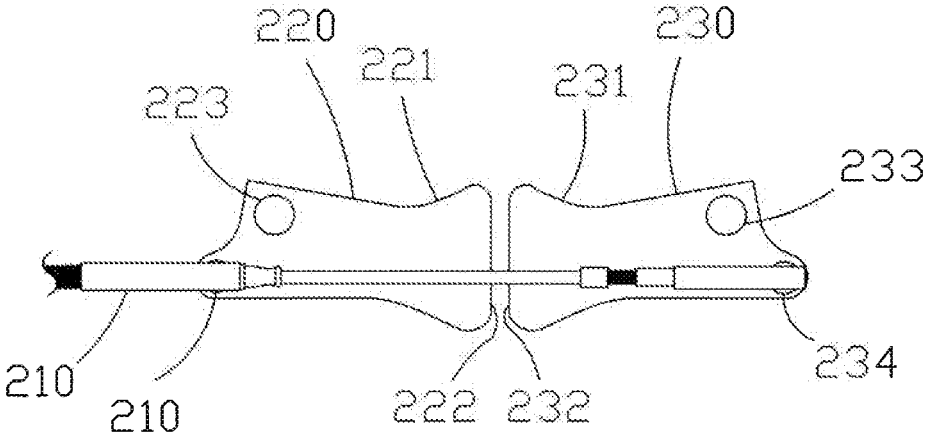
FIG. 14 shows the cams in an inactive or down position.
Figure 14A:
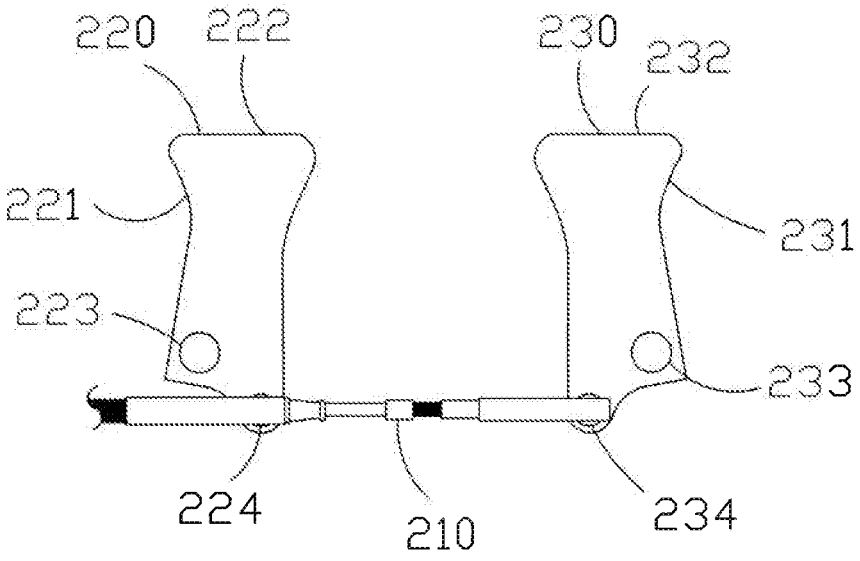
FIG. 14A shows the cams in an upright or active position.
Figure 15:
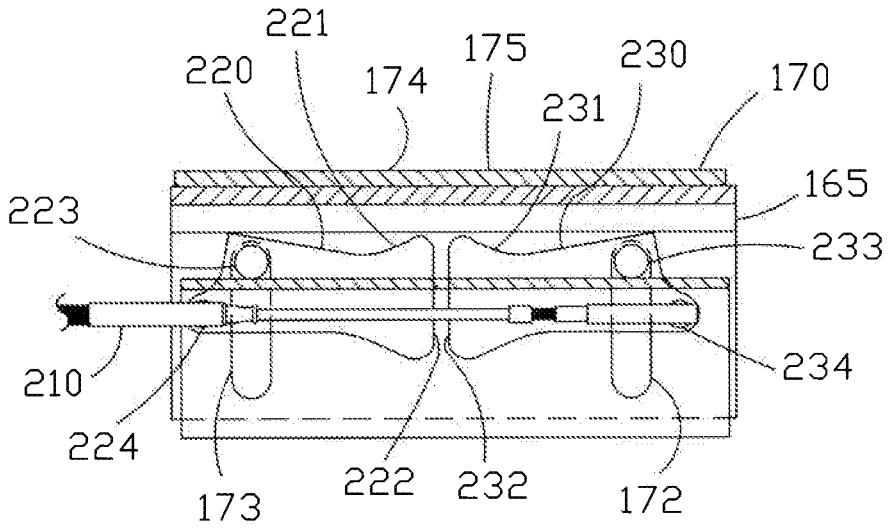
FIG. 15 is a side view of the cams within the base and extension block in the low position.
Figure 15A:
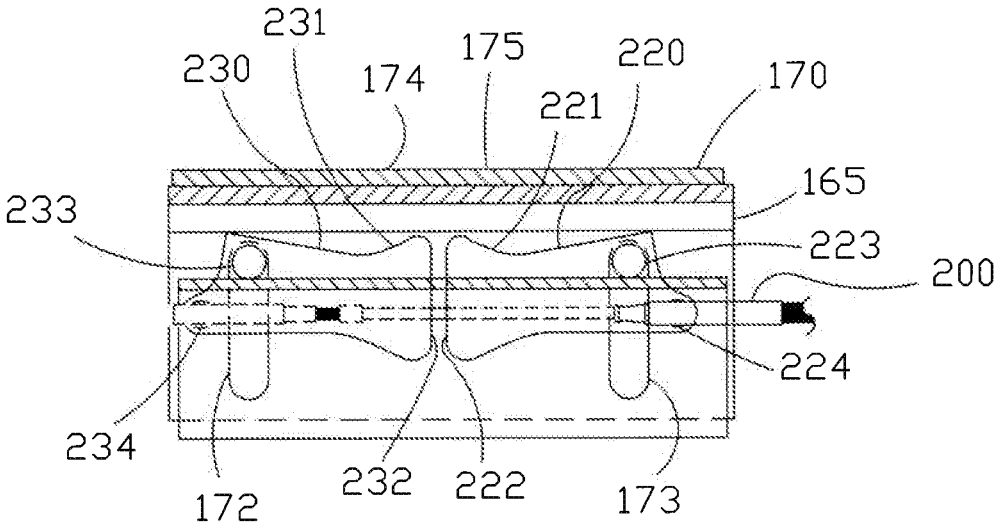
FIG. 15A is a reverse view of FIG. 15.
Figure 16:
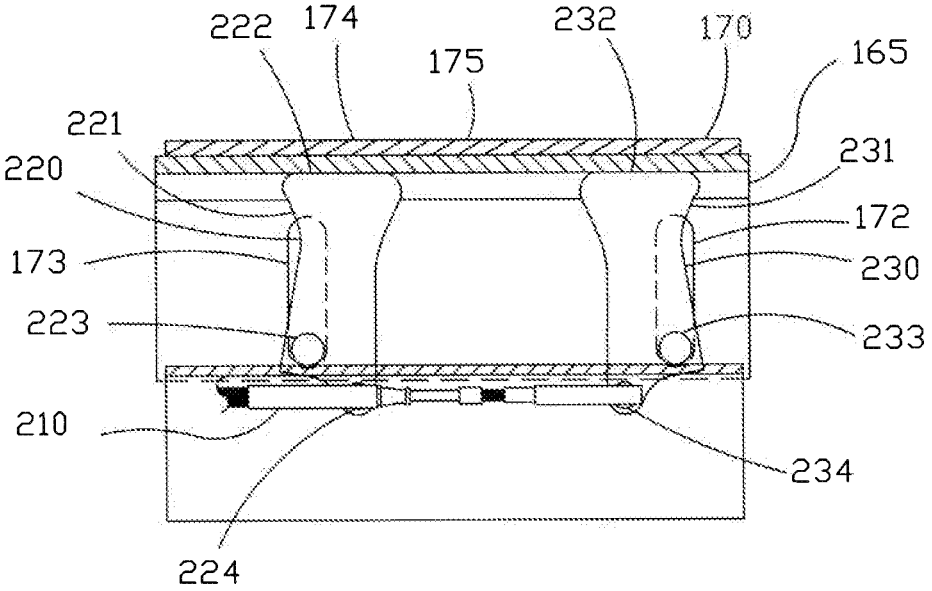
FIG. 16 is a side view of the cams within the base and extension block in the high position.
Figure 16A:
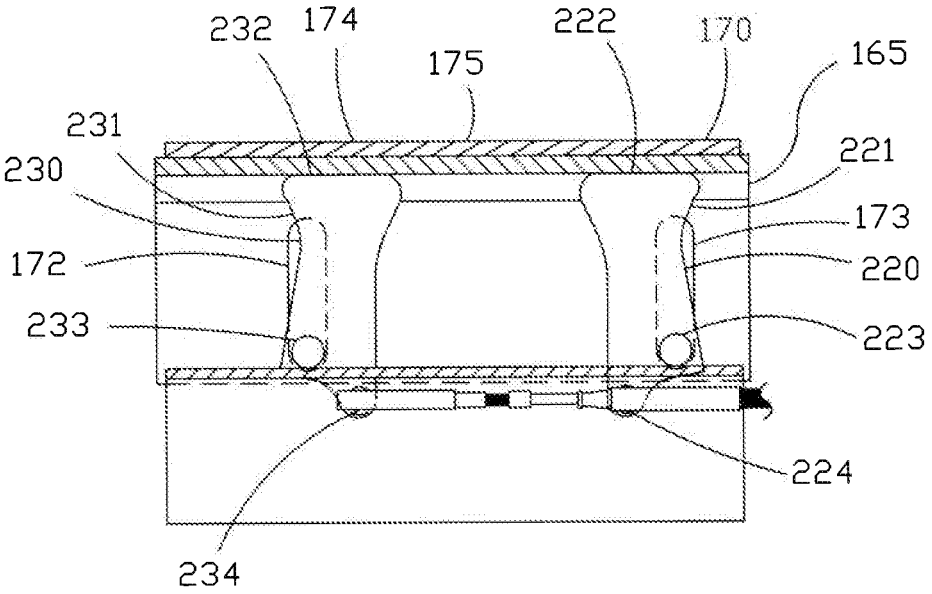
FIG. 16A is a reverse view of FIG. 16.
Figure 17A:
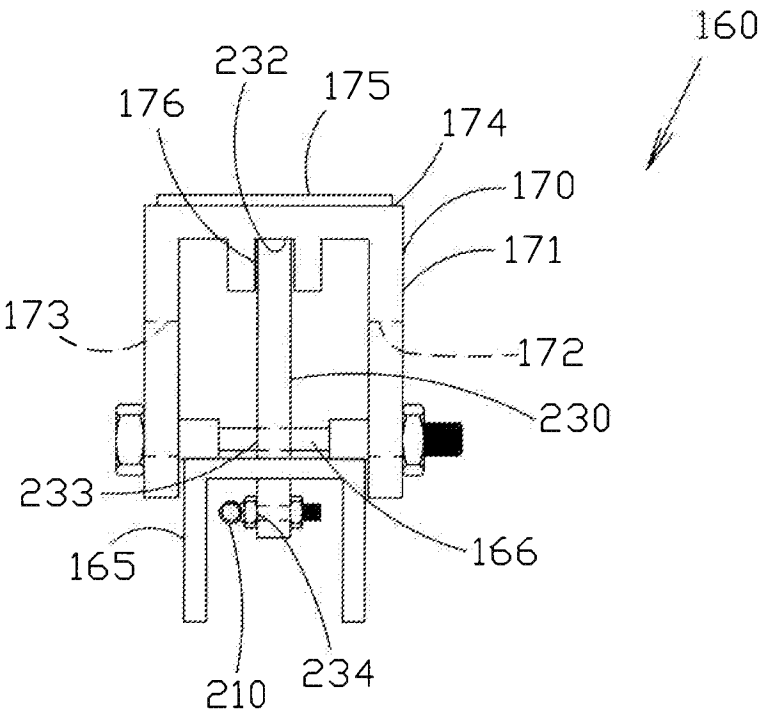
FIG. 17A is similar to FIG. 17, but shows the extension block in the high position.
Figure 17:
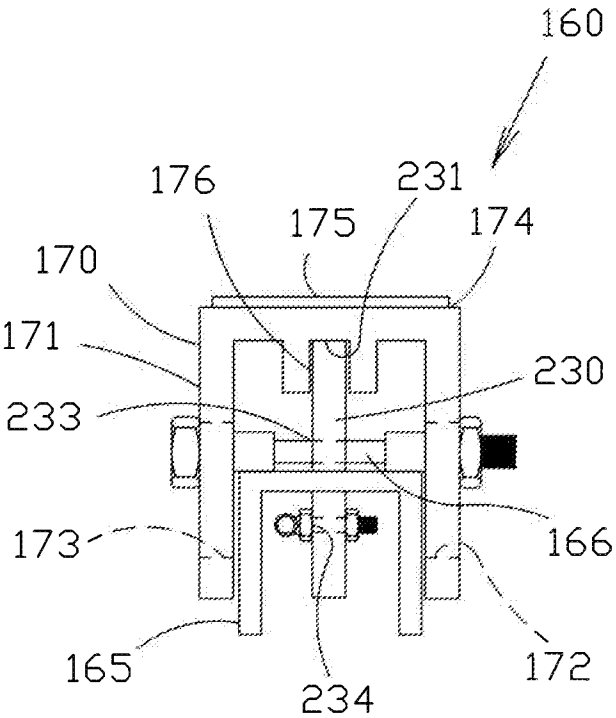
FIG. 17 is an end view of the cams within the base and extension block in the low position.

Turning now to FIGS. 10-17A, it is seen that a second preferred embodiment of a lift 120 is illustrated. Lift 120 has ends 123 and 124 and sides 125 and 126. Lift 120 has a lift frame 130 and an elevation assembly 280. The lift 120 is preferably made of strong materials such as steel. However, it is appreciated that other materials may be used without departing from the broad aspects of the present invention. Frame 130 has base arms 131, lift arms 135 and upper arms 140. These three sets of arms preferably act generally as a parallelogram in raising and lowering the upper arms 140 relative the base arms 131. The lift arms 135 are pivotally connected to the base arms 131 at one end and to the upper arms 140 at the opposite ends, respectively.

There are preferably two upper arms. The first upper arm preferably has a body bottom lower section engager 150. The engager 150 can have a pad 155 comprising a compressible or high friction material so that the trike 5 is engaged by the engager in a stable manner.

The second upper arm preferably has a body bottom higher section engager 160. Engager 160 has a base 165 and an extension block 170. The base 165 has two pins 166 and 167 fixed to the top of the base 165. The extension block 170 has sides 171 and a top 174. The top 174 has a pad 175 preferably of the same material as the material of pad 155. Each side 171 has vertical slots or channels 172 and 173, respectively. It is appreciated that while slots are shown to be vertically aligned, that other shapes or orientations may be utilized without departing from the broad aspects of the present invention.

A channel 176 is formed on the inside of the extension block 170 on the underside of the top 174. The channel 176 is preferably centrally aligned on the top 174 and spans the entire length of the top 174.

The pins 166 and 167 of the first piece extend within the two channels 172 and 173, respectively. In this regard, the extension block is raisable and lowerable to the two positions defined by the top and bottom, respectively, of the channels 172 and 173. In the low position, pad 175 is preferably about two inches higher than pad 155. However, in the high position, pad 175 is preferably about five inches higher than pad 155. In this embodiment, it is preferred that the extension block 170 is extended and compacted in a mechanical manner with a drive system 190.

Drive system 190 has a first cable 200 and a second cable 210. Two cams 220 and 230 are preferably provided. Yet, it is appreciated the more or fewer cams may be used without departing from the broad aspects of the present invention. Cam 220 has a side 221 and a top 222. A fixed pivot 223 is provided about pin 166. A cable pivot 224 is further provided. Cable pivot 224 orbits about the fixed pivot 223 when the cam pivots about the fixed pivot 223. Cam 220 has two positions, an inactive or low position, and a high or active position. The extension block 170 is in the low position when the cam 220 is in the low position. The extension block 170 is in the raised position when the cam 220 is cam is in the high or active position. It is appreciated that the top 222 of cam 220 is flat. In this regard, when a load is applied to the lift when the extension block 170 is in the high position, the cam is stable and in unable to be moved to the low position without overcoming the weight of the load.

Cam 230 is similar to cam 220. Cam 230 has a side 231, a top 232, a fixed pivot 233 (about pin 167) and a cable pivot 234. Yet, it is appreciated that cam 230 pivots or rotates in an opposite matter as cam 220. In this regard, cam 220 and cam 230 preferably operate in tandem, albeit, in opposite rotational manners. Yet, it is appreciated that the cams could operate with the same rotational directions without departing from the broad aspects of the present invention.

The cams 220 and 230 are received within the channel 176 when they are in the raised or active position. In this regard, the cams are laterally stable as the channel 176 maintains vertical alignment of the cams within the extension block 170.

A lever 240 is provided to selectably pull on cable 200 or 210. Cable 200 is placed under tension when the lever 240 is in a first position. Cable 210 is placed under tension when lever 240 is in the second position. Pulling on cable 200 causes the cams to move to the low position. Pulling on cable 210 causes the cams to move to a high position. A safety pin 241 can be provided for locking the lever in the second position wherein the cams are held in the high position.

The lever 240 is preferably held on the handle 290 of an elevation assembly. The elevation assembly 280 is similar to elevation assembly 80, and has a top arm 285 with a step 286 and side arms 287. A hydraulic lift 300, a release 310, locks 320 and floor engagers 315 are further provided.

In use, it is appreciated that the lift is inserted under the trike from the side 12 of the trike 5. The extension block 170 is preferably in the low position whereby it can clear the fender 17 and body bottom sections. Once in position, the extension block is preferably raises via the drive assembly 190 so that pad 175 is about five inches higher than pad 155. Elevation assembly is then used to cause the lift frame 130 to rise. Pad 155 engages the body bottom and pad 175 engages the body bottom high section (preferably the swing arm). In this regard, the weight of the trike 5 is centered on the lift and the lift can lift the trike in a stable manner.

Thus it is apparent that there has been provided, in accordance with the invention, for a trike lift and the methods of making and using the same that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A lift for a trike having a trike bottom with a trike bottom high section, said lift comprising:

a frame with a first upper arm and a second upper arm;

a lift mechanism selectably raising said first upper arm and said second upper arm;

a drive system having at least one cam with a fixed pivot and a top, said at least one cam having a low position when said at least one cam is rotated relative to said fixed pivot to a first orientation and said at least one cam having a high position when said at least one cam is rotated relative to said fixed pivot to a second orientation;

a body engager low section on said first upper arm; and a body engager high section on said second upper arm, said body engager high section having a base and an extension, said extension being selectably raised relative to said base when said at least one cam is rotated to said second orientation, and lowered relative to said base when said at least one cam is rotated to said first orientation, wherein said top engages said extension when said at least one cam is rotated to said second orientation, wherein said extension engages the trike bottom high section when said lift is used to lift the trike, wherein said at least one cam comprises a first cam and a second cam, said first cam having a first cam cable pivot and said second cam having a second cam cable pivot, said first cam and said second cam being rotatable in opposite directions under operation of a lever as said first cam cable pivot and said second cam cable pivot move towards or away from each other.

2. The lift of claim 1 wherein said extension is extendable relative to said base.

3. The lift of claim 1 wherein said extension is mechanically extendable relative said base with said drive system.

4. The lift of claim 1 wherein said lift further comprises a handle and said lever, said drive system being operable by said lever.

5. The lift of claim 1 further comprising a safety pin.

6. The lift of claim 5 wherein said safety pin selectably locks said lever in a selected position.

7. The lift of claim 1 wherein said at least one cam has a flat top, wherein said flat top engages said extension when said at least one cam is in said high position.

8. The lift of claim 1 further comprising an elevation assembly, said elevation assembly comprising a first side arm, a second side arm and a top arm with a step, said step having a first portion that is generally perpendicular to a second portion.

9. A lift for a trike having a trike bottom with a trike bottom high section, said lift comprising:

a frame with a first upper arm and a second upper arm;

a lift mechanism selectably raising said first upper arm and said second upper arm:

a body engager low section on said first upper arm; and a body engager high section on said second upper arm and having a base and an extension, a drive system for selectably moving said body engager high section from a low position to a raised position, said drive system comprising a cam with a fixed pivot and a top, wherein said extension is raised relative to said base upon rotation of said cam and wherein said top engages said extension when said cam is rotated to a cam raised position;

a lever operable with a cable to operate said cam to move from a cam low position to said cam raised position;

wherein said extension engages the trike bottom high section when said lift is used to lift the trike, wherein said cam is a first cam, said lift further comprising a second cam, said first cam having a first cam cable pivot and said second cam having a second cam cable pivot, said first cam and said second cam being rotatable in opposite directions under operation of said lever as said first cam cable pivot and said second cam cable pivot move towards or away from each other.

10. The lift of claim 9 wherein said cam has a flat top.

11. A lift for a trike having a trike bottom with a trike bottom high section, said lift comprising:

a frame with a first upper arm and a second upper arm;

a lift mechanism selectably raising said first upper arm and said second upper arm;

a body engager low section on said first upper arm;

a body engager high section on said second upper arm and having a base, a first cam, a second cam and an extension, wherein said first cam has a first cam cable pivot and said second cam has a second cam cable pivot, said first cam and said second cam being rotatable in opposite directions under operation of a lever as said first cam cable pivot and said second cam cable pivot move towards or away from each other, and said extension being selectably raised relative to said base under operation of said first cam and said second cam; and a drive system for selectably moving said body engager high section from a low position to a raised position;

wherein said extension engages the trike bottom high section when said lift is used to lift the trike.

12. The lift of claim 11 wherein said first cam has a flat top.

* * * * *